United States Patent [19]

Whitman

[11] 3,946,392

[45] Mar. 23, 1976

[54] ELECTRICALLY SHORT TRANSMISSION LINE ANTENNA

[75] Inventor: Robert E. Whitman, Asbury Park, N.J.

[73] Assignee: The United States of America as represented by the Secretary of the Army, Washington, D.C.

[22] Filed: Feb. 19, 1975

[21] Appl. No.: 551,187

[52] U.S. Cl. ..... 343/830; 343/845; 343/895

[51] Int. Cl.[2] ..... H01Q 1/36

[58] Field of Search ..... 343/830, 845, 895, 723, 343/846

[56] References Cited

UNITED STATES PATENTS

| | | | |
|---|---|---|---|
| 2,431,124 | 11/1947 | Kees et al. | 343/845 |
| 2,578,154 | 12/1951 | Shanklin | 343/845 |

*Primary Examiner*—Eli Lieberman

*Attorney, Agent, or Firm*—Nathan Edelberg; Robert P. Gibson; Kenneth J. Murphy

[57] ABSTRACT

At least one but preferably two shorted transmission line antenna sections, each comprised of a vertical member shorting a horizontal printed circuit transmission line member to a ground plane with the transmission lines being adjustable in length for tuning by utilization of a flexible braid transmission line member connected between the printed circuit transmission line member and a take-up spindle which is adapted to be rotated and accordingly wind or unwind the braid member thereon. The feed point is at the connection of a pair of fixed capacitors, one of which is connected to ground plane while the other is connected to the take-up spindle.

16 Claims, 7 Drawing Figures

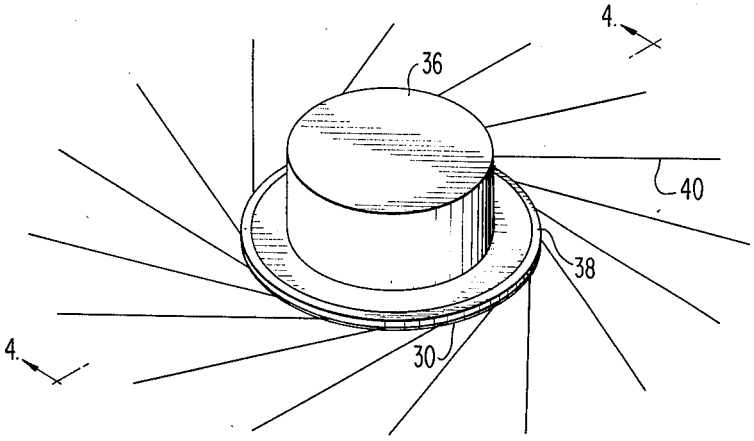
FIG. 3
FIG. 4
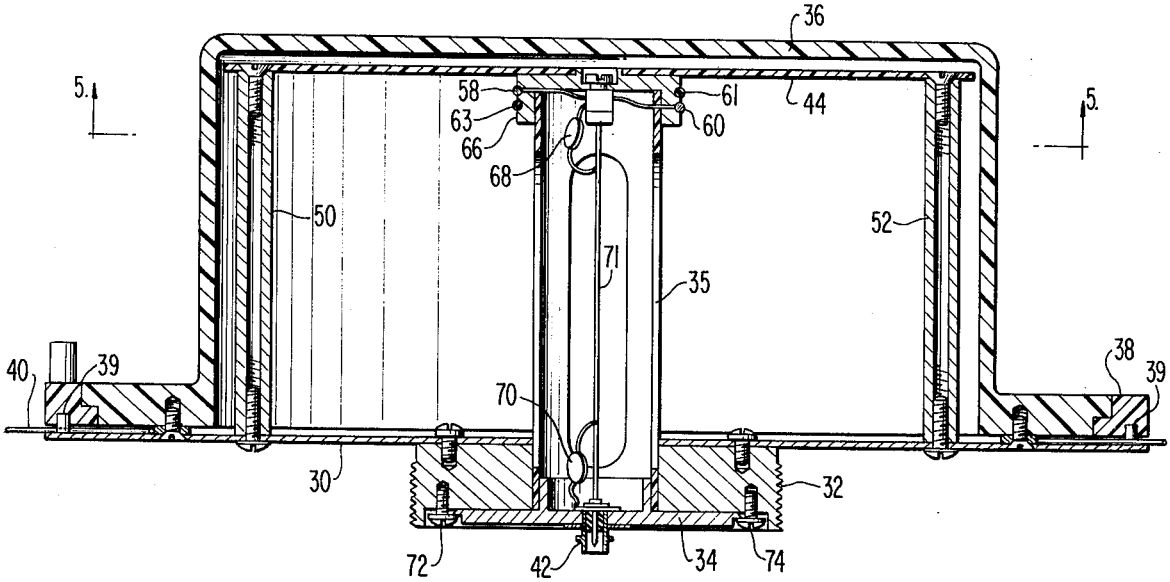
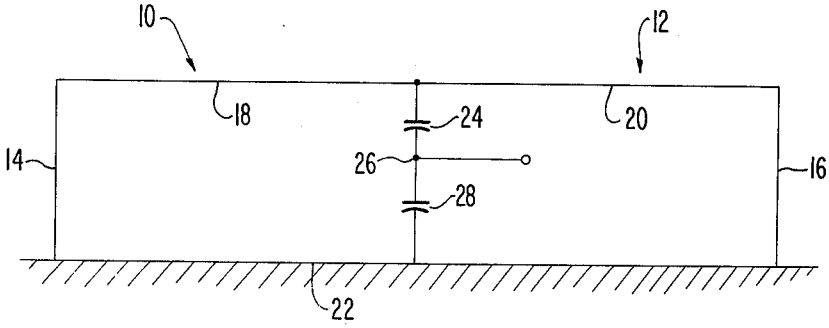
FIG. 1

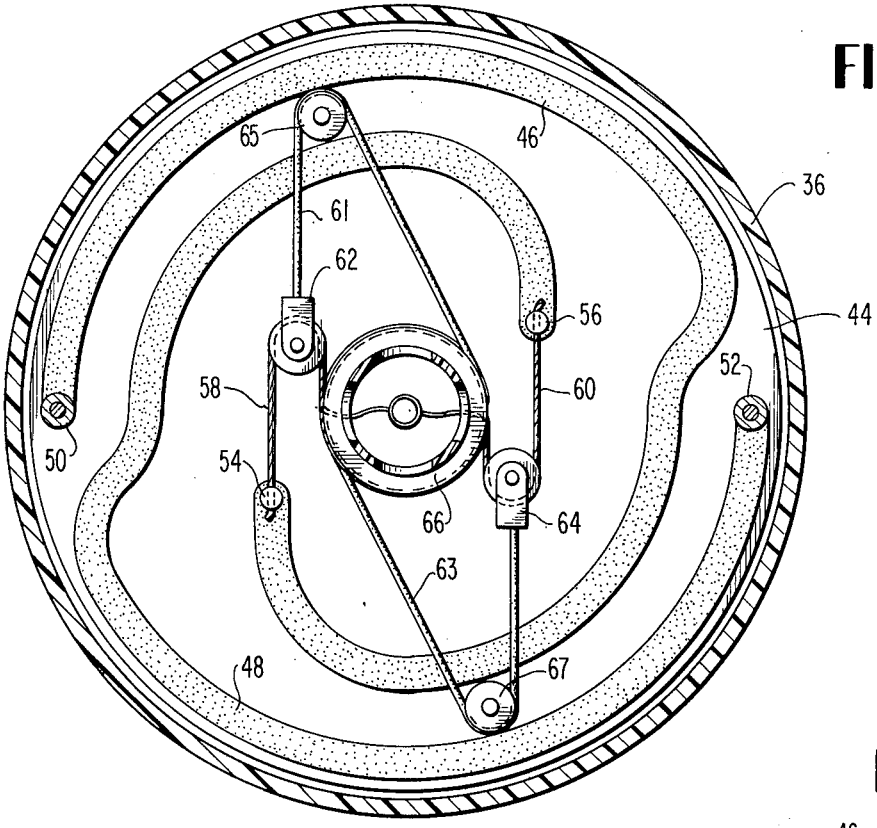
FIG. 5
FIG. 6
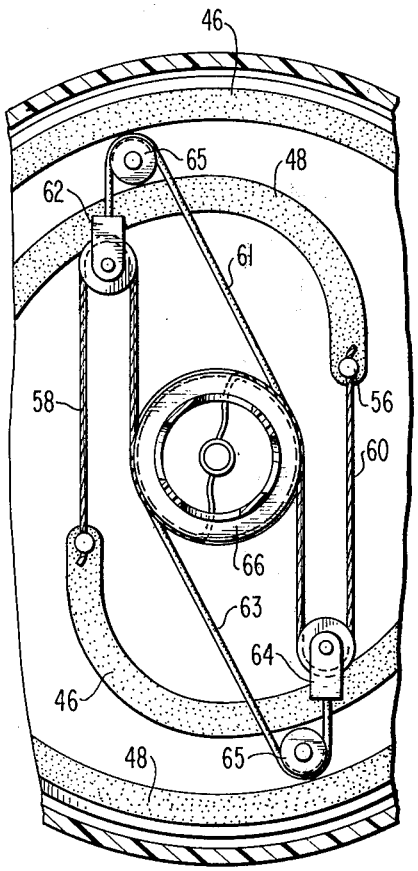
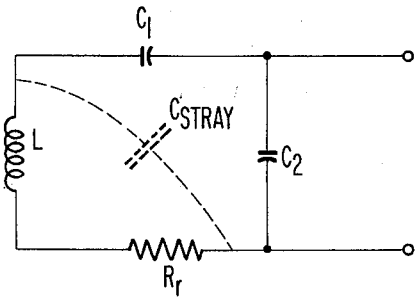
FIG. 2

ELECTRICALLY SHORT TRANSMISSION LINE ANTENNA

The invention herein may be manufactured and used by or for the Government for governmental purposes without the payment of any royalties thereon or therefor.

BACKGROUND OF THE INVENTION

This invention relates to electromagnetic wave antennas and more particularly to a transmission line antenna.

A transmission line antenna is similar to the directly driven resonant radiator type of antenna, except that two capacitors are used as a matching network instead of directly feeding the antenna at an impedance tap as well as consisting of a variable section of shorted transmission line having a length less than a quarter wavelength of the operating frequency. The transmission line input impedance remains substantially inductive over the frequency range. The capacitors, moreover, are adapted not only to resonate the antenna to the desired frequency, but also act as an impedance divider to provide the required input impedance, for example, 50 ohms. Several sections of shorted transmission line when desirable can be placed parallel across the tuning capacitors. The parallel combination of transmission line antennas reduces the input inductive reactance to facilitate matching and results in a more omnidirectional radiation pattern.

SUMMARY

Briefly, the subject invention is directed to a shorted transmission line antenna comprised of at least one but preferably two transmission line sections connected in parallel across a pair of capacitors which have a common connection which acts as the antenna feed point. The other side of one capacitor is connected to a metal ground plane, while the other side of the other capacitor is connected to each transmission line section which respectively includes a spiral strip transmission line member, a flexible braid transmission line member both of which are horizontal to the ground plane and a vertical transmission line member terminating in the ground plane. One end of the flexible braid connects to the strip transmission line while the other end is connected to a take-up spindle through a tensioned pulley, so that the rotation of the take-up spindle is adapted to wind or unwind the flexible transmission line member thereon and thereby change the electrical length of the transmission line to tune the antenna to the desired operating frequency. Additionally, when desirable, a plurality of flexible ground radials are provided which can be deployed to eliminate any ground influence having a tendency to detune the antenna.

BRIEF DESCRIPTION OF THE DRAWINGS

FIG. 1 is a schematic diagram illustrative of a two section transmission line antenna;

FIG. 2 is an electrical equivalent circuit diagram of the antenna shown in FIG. 1;

FIG. 3 is a perspective view of the external housing of the preferred embodiment of the subject invention with ground radials extended;

FIG. 4 is a central cross-sectional view of the embodiment shown in FIG. 3 taken along the lines 4—4 thereof disclosing the internal construction of the subject invention;

FIG. 5 is a plan view of the embodiment as shown in FIG. 4 taken along the lines 5—5 thereof;

FIG. 6 is a fragmentary view of the arrangement shown in FIG. 5 illustrating the operation of the subject invention.

DESCRIPTION OF THE PREFERRED EMBODIMENT

Figure 7:
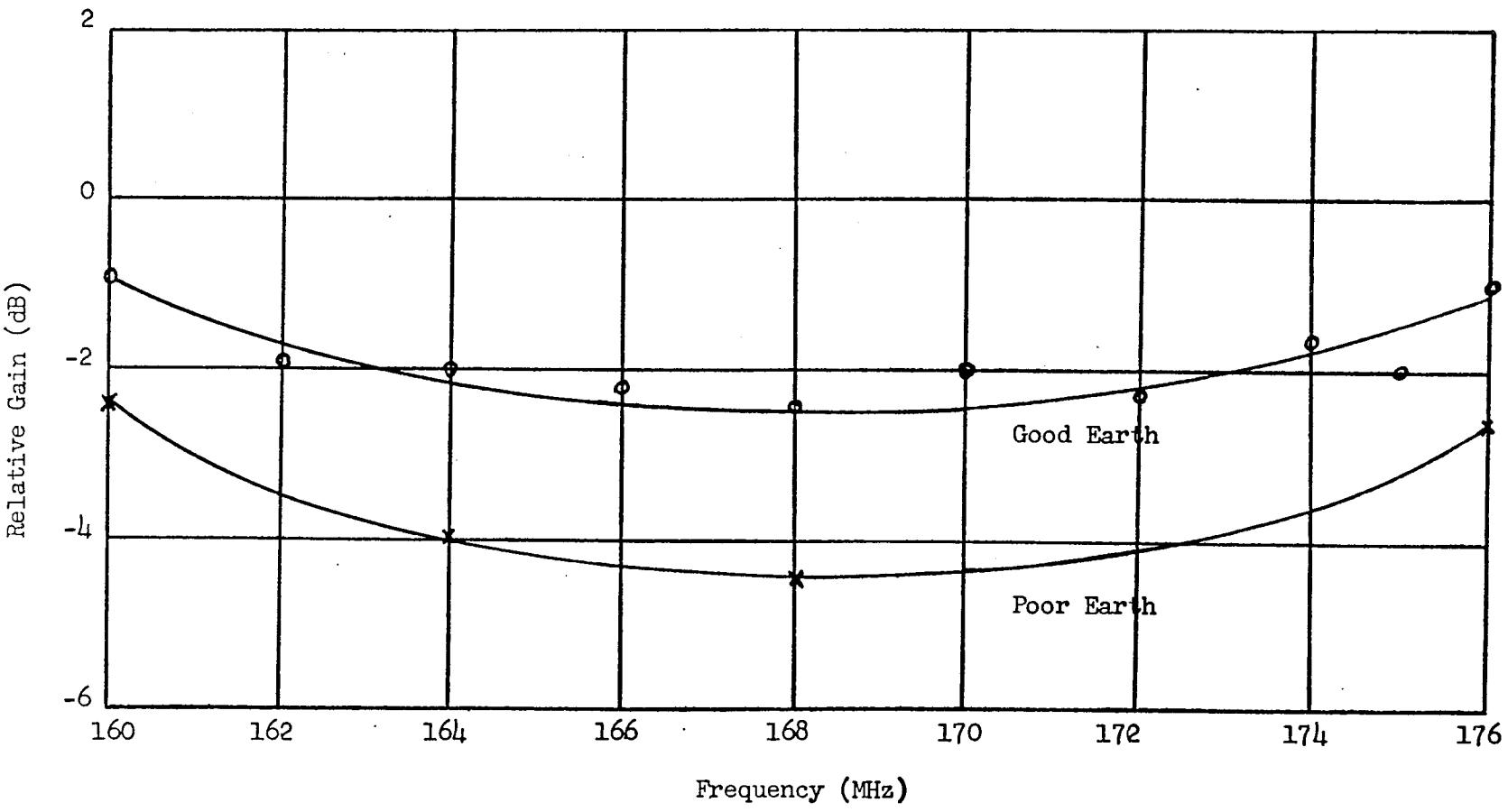
FIG. 7 is a graph illustrative of the operational characteristics of the subject invention.

As noted above, a transmission line antenna is similar to a directly driven resonant radiator type of antenna, except that two capacitors are used as a tuning and matching network instead of directly feeding the antenna at a predetermined impedance tap. When desirable, several sections of shorted transmission line can be placed in parallel across the capacitor network. Such an arrangement is shown in FIG. 1 which schematically illustrates such an antenna and one consisting of two shorted transmission line antennas in parallel. More particularly, reference numeral 10 designates one transmission line, while reference numeral 12 denotes the other transmission line. The transmission lines 10 and 12 respectively include vertical shorting members 14 and 16 and horizontal transmission line members 18 and 20, which are located above a ground plane 22. The vertical shorting members 14 and 16 terminate the transmission lines 10 and 12 in the ground plane 22; however, the other extremity is connected to one side of a capacitor 24. The other side of the capacitor is connected to a feed point 26, which is also common to one side of a second capacitor 28 which is connected to the ground plane 22. The two capacitors 24 and 28 provide the proper input impedance as well as a means for resonating the antenna. The electrical length of the transmission lines 10 and 12 are less than one quarter wavelength of the operating frequency. As such, an in-phase current standing wave is developed wherein a current maximum develops on the vertical shorting members 14 and 16 of the transmission line which gradually reduces along the horizontal members 18 and 20 becoming substantially zero at the feed point 26. Further, when the radiation characteristics are considered, maximum radiation will occur from the vertical members 14 and 16 where the largest current is developed and will have a vertical polarization. Radiation from the horizontal members 18 and 20 is substantially cancelled by the close proximity to the ground plane 22. Further since the vertical members 14 and 16 are the predominant radiating element, the radiated pattern is nearly omnidirectional.

The equivalent circuit of the transmission line antenna is shown in FIG. 2. The effective series capacitance $C_1 + C_2 + C_{STRAY}$ resonates the antenna to the operating frequency while the impedance dividing characteristic of both series connected capacitors $C_1$ and $C_2$ is adapted to provide a predetermined input impedance terminal (50 ohms).

The input impedance $R_{in}$ is determined by the ratio of capacitor $C_1$ to $C_2$. If the capacitors 24 and 28 are fixed in value and capacitor 24 i.e., $C_1$ takes on a minimum value, a constant input impedance across the frequency range results with optimized gain. Accordingly, tuning of the antenna is provided in the subject invention by varying the electrical length of the horizontal transmission line members 18 and 20 shown in FIG. 1.

To this end, attention is now directed to FIGS. 3 through 6, which discloses the physical configuration of the preferred embodiment of the subject invention. The ground plane as shown in FIG. 4 comprises a circular metal base plate 30, which includes a mounting base 32 and a tuning control member 34. A fiberglass radome 36 together with a ground radial take-up ring 38 and sixteen silver plated stainless steel ground radials 40 shown in FIG. 3 are secured to the base plate 30. Additionally, an input RF coaxial connector 42 feeds through the tuning control member 34 for coupling the antenna to the radio apparatus with which it is used. The take-up ring 38 is rotatable and includes elements 39 which are adapted to engage the radials 40 so that they can either be deployed or retracted depending upon the amount of rotation applied to the take-up ring.

The internal construction of the antenna is shown in FIGS. 4, 5 and 6. A circular printed circuit board 44 includes two strip transmission line elements 46 and 48 (FIG. 5) generally configured as adjacent coils in the form of spirals respectively connected at one end to two vertical metal posts 50 and 52 which are adapted to be secured to the circular base plate 30. The posts 50 and 52 short the strip transmission line elements 46 and 48 to the base plate 30 as shown in FIG. 3. The strip transmission line elements 46 and 48 spiral inwardly from the posts 50 and 52 and connect to two smaller posts 54 and 56, to which is attached flexible metallic braid conductor elements 58 and 60 which feed around tensioned pulleys 62 and 64 and attach to a take-up spindle 66 which is adapted to be connected to the antenna tuning control element 34 shown in FIG. 4 by means of the drive shaft 35. Tension is applied by flexible cables 61 and 63 attached from the pulleys 62 and 64 to the spindle after passing around fixed pivot assemblies 65 and 67. Rotation of the tuning control plate 34 forces the take-up spindle to wind or unwind the braid elements 58 and 60 as shown in FIGS. 5 and 6 to effectively change the electrical length of the antenna elements and thus tune the antenna in combination with capacitors 68 and 70 over the desired frequency range.

Capacitor 68 comprises one of a pair of fixed capacitors, the other being capacitor 70. Capacitor 68 is located adjacent the take-up spindle while capacitor 70 is located adjacent the mounting base on the RF connector 42. The capacitors are commonly connected to the coaxial connector 42 by means of circuit lead member 71. Finally, a pair of set screws 72 and 74 are located on the inner edge of the mounting base 32 for locking the tuning control plate 34 so that once the structure has been tuned by rotating the spindle 66, further tuning is prohibited until the set screws are loosened once again.

Where applicable, all components are silver plated to reduce ohmic losses. The use of high RF grade printed circuit board for the strip line transmission elements 46 and 48 as opposed to copper tubing introduces a loss of approximately 0.5dB in antenna efficiency. The advantages, however, of control of the transmission line geometry more than compensates for the loss introduced. The use of fixed capacitors with tuning being accomplished by changing the length of the transmission line moreover results in a constant input impedance across the frequency range typically 160MHz–176MHz and requires the adjustment of only one element for tuning the antenna, i.e., the control member 34 shown in FIG. 4. Additionally, optimized gain is accomplished thereby.

The antenna as described has a typical overall height of 0.05 wavelength as measured from the base plate 30 to the top of the printed circuit board 44 and a width of 0.10 wavelength as measured between the vertical shorting members 50 and 52 and as such is interpreted as being electrically small.

An antenna constructed in accordance with the details shown in FIGS. 4 through 6 exhibited typical performance characteristics which are set forth in the following Table I and FIG. 7. The antenna performance characteristics were determined by measurements taken with the subject antenna operated directly on the surface of the ground above an underground test chamber with an RF cable connecting the subject antenna to test instrumentation located five feet below the earth's surface. The results presented in Table I and FIG. 7, moreover, are presented in direct comparison to an ADSID antenna (quarterwave monopole with four quarter-wave ground radials). Additionally, a comparison is made in FIG. 7 for the subject antenna operating over poor earth (sand and gravel) and over good earth (a 24 inch × 24 inch ground screen).

Referring to Table I, there is listed the relative values of measured field strengths radiated by the antenna as it was rotated through 360°. Measurements were recorded for every 22.5° of movement. A study of the values indicates that the pattern is omnidirectional within a deviation of ± 0.3dB.

TABLE I

| RADIATED PATTERN | | | |
|---|---|---|---|
| Rotation (degrees) | Relative Field Strength (dB) | Rotation (degrees) | Relative Field Strength (dB) |
| 0 | 0 | 202.5 | 0 |
| 22.5 | −0.2 | 225 | −0.2 |
| 45 | +0.2 | 247.5 | −0.3 |
| 67.5 | 0 | 270 | −0.3 |
| 90 | −0.2 | 292.5 | −0.3 |
| 112.5 | −0.3 | 315 | −0.3 |
| 135 | −0.3 | 337.5 | −0.3 |
| 157.5 | −0.3 | 360 | −0.2 |
| 180 | 0 | | |

Considering the relative gain of the antenna compared to the ADSID antenna as depicted in the graph in FIG. 7, the gain varies from −2.5dB when measured over good earth to −5dB when measured over poor earth. For intermediate ground conditions the gain would lie somewhere between these limits.

What has been shown and described therefore is an electrically small transmission line antenna which is particularly adapted for operation in the 160MHz to 176MHz frequency range. The antenna moreover provides an omnidirectional radiation pattern with a radiation gain within −2.5dB of a quarter-wave monopole when operated over relatively good ground and additionally is adapted to provide a 50 ohm input impedance. Ground radials additionally are provided to eliminate the earth influence in detuning the antenna; however, the radials are not required when the antenna is operated on vehicles or over surfaces having good conductivity.

Having thus described what is considered to be the preferred embodiment of the subject invention,

I claim:

1. An electrically short electromagnetic wave antenna comprising at least one section of shorted transmission line having a length less than a quarter wavelength of the operating frequency wherein the improvement comprises:

a metal ground plane;

a substantially vertical transmission line member terminating at one end in the ground plane;

a strip transmission line member mounted substantially parallel to the ground plane and terminating at one end in the other end of said vertical transmission line member;

a flexible transmission line member, also substantially parallel to the ground plane, coupled at one end to the other end of said strip transmission line member;

a rotatable spindle including an electrical conductive element coupled to the other end of said flexible transmission line member and being adapted to wind a predetermined portion of said flexible transmission line member thereon when rotated to vary the electrical length of the shorted transmission line formed by said above recited transmission line members;

first and second series connected capacitor means respectively adapted to act as tuning means and impedance matching means, said first capacitor means having one side coupled to the electrical conductive element of said spindle and said second capacitor means having one side coupled to the ground plane; and input means adapted to be coupled to radio apparatus coupled to the common connection between said first and second capacitor means.

2. The antenna as defined by claim 1 wherein the substantially vertical transmission line member has a length substantially less than the combined length of said strip transmission line member and said flexible transmission line member.

3. The antenna as defined by claim 2 wherein said strip transmission line member comprises a printed circuit conductor fabricated on a printed circuit board in a curvilinear configuration.

4. The antenna as defined by claim 3 wherein said curvilinear configuration defines a coil lying in a common plane parallel to the ground plane.

5. The antenna as defined by claim 4 wherein said coil is in the form of a spiral.

6. The antenna as defined by claim 5 wherein said flexible transmission line member comprises a length of flexible braid conductor.

7. The antenna as defined by claim 6 and additionally including tensioning means on said braid conductor for keeping the conductor taut irrespective of the amount of braid conductor wound on said spindle.

8. The antenna as defined by claim 7 wherein said tensioning means comprises a pulley configuration engaging said braid conductor and being coupled to the spindle and moved thereby when rotated.

9. The antenna as defined by claim 8 wherein said pulley configuration includes a flexible coupling member running around a post fixedly attached to said printed circuit board.

10. The antenna as defined by claim 9 and additionally including a mounting base on said ground plane and drive shaft means through said mounting base coupled to said take-up spindle.

11. The antenna as defined by claim 10 and additionally including drive shaft locking means for preventing rotation of said spindle following the tuning of the antenna to a predetermined operating frequency.

12. The antenna as defined by claim 1 and additionally including a radome enclosing said at least one section of shorted transmission line, said radome being attached to the circular base plate.

13. The antenna as defined by claim 1 wherein said first and second capacitor means comprises first and second fixed capacitors.

14. The antenna as defined by claim 1 and additionally including:

another substantially vertical transmission member terminating at one end in the ground plane;

another strip transmission line member oriented substantially parallel to the ground plane and terminating at one end in the other end of said another vertical transmission line member; and another flexible transmission line member also substantially parallel to the ground plane coupled at one end to said strip transmission line member, with the other end of said another flexible transmission line member being coupled to said electrical conductive element.

15. The antenna as defined by claim 14 wherein said substantially vertical transmission line members are of substantially equal length, and wherein said strip transmission line members comprise printed circuit transmission lines fabricated on a common printed circuit board and being configured as coplanar coils.

16. The antenna as defined by claim 15 wherein said coplanar coils are configured as adjacent spirals.

* * * * *